US005758797A

United States Patent [19]

Martindale

[11] Patent Number: 5,758,797

[45] Date of Patent: Jun. 2, 1998

[54] SPILL RESISTANT POWDER CONTAINER

[76] Inventor: Jack E. Martindale, 407 County Line Rd., Royce City, Tex. 75089

[21] Appl. No.: 670,325

[22] Filed: Jun. 25, 1996

[51] Int. Cl.[6] ..... B65D 51/18

[52] U.S. Cl. ..... 220/719

[58] Field of Search ..... 220/719

[56] References Cited

U.S. PATENT DOCUMENTS

| | | | |
|---|---|---|---|
| 3,313,447 | 4/1967 | Spencer | 220/719 |
| 3,360,161 | 12/1967 | Smith | 220/719 |
| 3,464,599 | 9/1969 | Meth | 222/589 |
| 3,781,164 | 12/1973 | McCaffery | 220/719 |
| 4,130,215 | 12/1978 | Corey et al. | 220/719 |
| 4,162,010 | 7/1979 | Hovsepian | 206/823 |
| 4,176,205 | 11/1979 | Molina | 427/1 |
| 4,714,174 | 12/1987 | Williams | 220/719 |
| 4,869,390 | 9/1989 | Kennedy | 220/90.4 |

*Primary Examiner*—Joseph M. Moy
*Attorney, Agent, or Firm*—Sidley & Austin

[57] ABSTRACT

A spill resistant container for light weight powders is disclosed. The container has retaining members which allow a fine powder to be retained in the container when the container is dropped or knocked over. The present invention also discloses a top for a common household jar which can be modified to allow for use as a spill resistant container. The container has a first retaining member in the shape of a conical section with the large opening at the upper end, and a second retaining member positioned above the first retaining member.

5 Claims, 2 Drawing Sheets

SPILL RESISTANT POWDER CONTAINER

TECHNICAL FIELD OF THE INVENTION

The present invention relates to a spill resistant container for holding light-weight powders. In particular, the invention relates to a spill resistant container for use with fingerprint dusting powders.

BACKGROUND OF THE INVENTION

This invention relates to a spill resistant container for fingerprint powder. Heretofore, fingerprint powder was placed in an open jar into which an applicating brush was dipped and then surfaces dusted for fingerprints. Conventional latent fingerprint developing powders are very finely divided powdered solid materials which are spread over latent fingerprints in order to bring out the pattern. Various substances have been utilized for powders such as fingerprint developing powder, i.e., powdered metals like aluminum and bronze, dragon's blood powder, a grey powder consisting of a finely ground french chalk and mercury, and black powders employing lamp black, carbon black or a charcoal base. Other materials used include talc and silica. Fingerprint powders may also include pearlescent dyes, florescent dyes and additives to bring out contrast in the print. As the phrase dusting implies, these developing powders are very light weight and easily dispersed. Typical fingerprints powders have a very low bulk density and will rapidly disperse. This characteristic means that powders frequently are spilled or ejected from the container by action of the dipping of the brush into the container, sneezes, gusts of wind, and thus, a host of other motive forces can expel the fingerprint powder from the container. Additionally, jars are frequently dropped or tipped over resulting in the spill of the powder.

Preventing spills or escape of excessive powder is desirable for at least two reasons. The first is to avoid contamination of or obliteration of latent fingerprints by too much dusting powder and the second is to avoid damage by staining furniture, carpets, rugs, etc.

The present invention is advantageous over prior containers. One object of the present invention is to provide a spill resistant container which can effectively trap very light finely divided powders in the event the container is tipped over. Another object of the present invention is to provide a container such that if a container is righted after it has been tipped over the retained powders would flow back to the lowest section of the container. Another object of the present invention is to provide a container designed to allow the easy insertion and removal of an application brush. Another object of the present invention is to provide a surface to wipe the outer edges of the application brush which will return the material to the container. Another object of the present invention is to provide a closure for a standard container to convert it into a spill resistant container.

SUMMARY OF THE INVENTION

The present invention is a spill resistant container having a bottom, and a wall extending upwardly from the bottom which defines a container. A first retaining member is located within the container and is in the form of a elongate passageway which has a first and second end, the second end being attached to the wall of the container at a location spaced apart from the bottom of said container, and the first end of said passageway is spaced apart from the bottom of the container and located between the bottom of the container and the second end of the passageway. In the preferred embodiment, the second end of the passageway is an opening of a larger cross-sectional area than the opening of the first end of the passageway. The container also includes a second retaining member which forms an inwardly extending ridge around the upper end of the container, said ridge being located above the second end of the first retaining member.

In a preferred embodiment, the container has a substantially circular bottom with a cylindrical sidewall extending therefrom to form a container. Positioned within the side wall is a passageway formed by a truncated conical section with the larger end of the conical section oriented such that the smaller end of the conical passageway is spaced apart from the bottom of the container and the upper end of the conical member is the larger opening and is attached to the side wall at a greater distance from the bottom than the lower end. Above the conical section and attached to the side wall extending inwardly is a second retaining member. This member being an inwardly extending wall for a predetermined distance but which does not close off the container.

In another embodiment, to a spill resistant adapter for attachment to standard containers to form a spill resistant container. An adapter is provided which has a member having a mating surface dimensioned to interface with a predetermined container, and an elongate passageway attached to the mating surface which has a lower end and an upper end. The opening at the lower end of the passageway being of a smaller cross-sectional area than the passageway at the upper end. Extending from the member having a mating surface is an inwardly projecting ridge at a predetermined distance. When the adapter is attached to a standard container, such as a commercially available jar which has no internal retention mechanism, the jar can be made spill resistant by attaching the adapter of the present invention to the jar.

DETAILED DESCRIPTION

Figure 1:
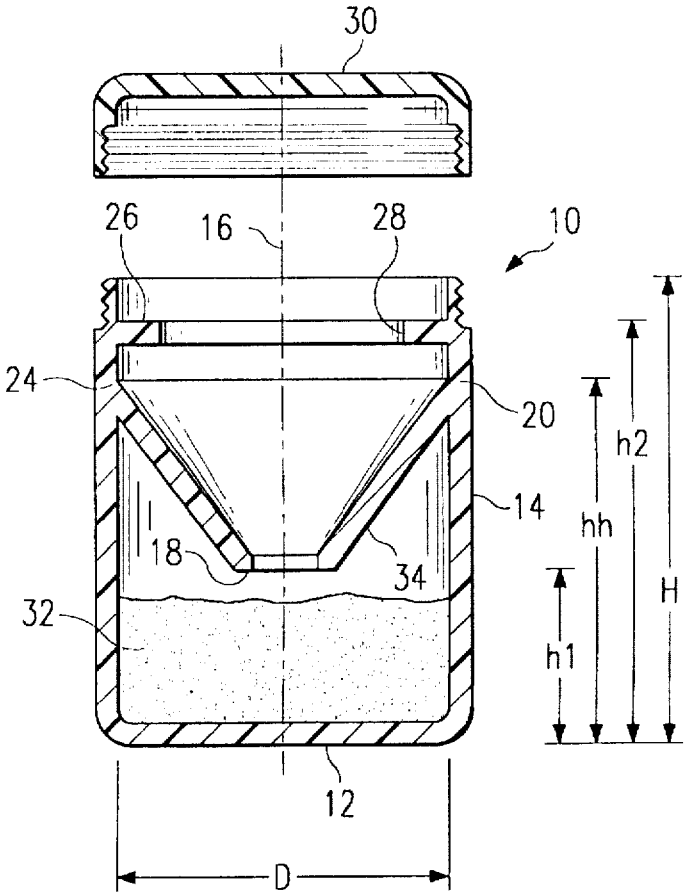
FIG. 1 is a cross-sectional view of one embodiment of the present invention.
Figure 4:
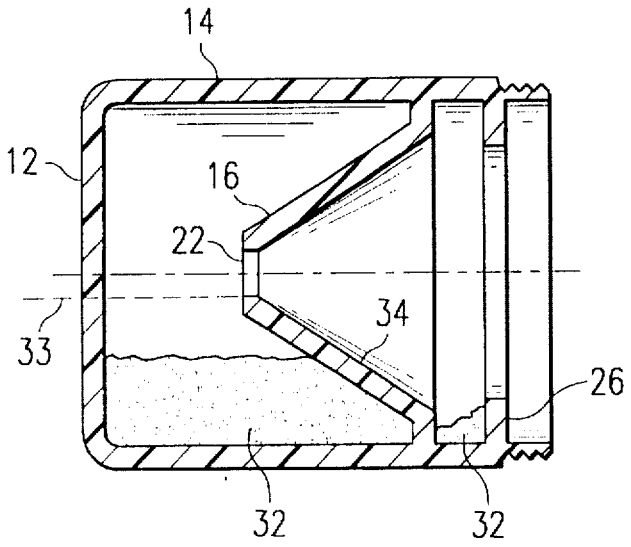
FIG. 4 is a cross-sectional view of an embodiment of the invention on its side.

Referring to FIG. 1, there is shown the spill resistant container 10. The container 10 is formed from a bottom 12 and extending side wall 14. In the embodiment shown, the bottom is circular and the side wall is cylindrical forming the shape of a common jar. However, the cross-sectional shape of the device is not critical and the container may be square, rectangular, oval, etc. In the preferred embodiment, the container defines an axis 16 which passes through the bottom and extends vertically. Within the container 10 is a first retaining member 16. First retaining member 16 has a first end 18 and a second end 20. Retaining member 16 forms a elongate passageway. In the preferred embodiment, the elongate passageway has a smaller opening 22 at its first (lower) end and a larger opening 24 at its second (upper)

end. Preferably the upper end 20 of elongate passage 16 is connected with side wall 14 at a distance spaced apart from bottom 12. First retaining member 16 may be integrally formed with side wall 14, or may be attached to side wall 14 by suitable means such as friction fit, glue, threaded connection, etc. The container has a second retaining member 26 located above the first end 20 of the first retaining member 16. Retaining member 26 is in an inwardly extending member forming a ridge about the upper portion of the container. The ridge is at any orientation sufficient to prevent escape of powder when the container is laying on its side. A ridge which extends substantially perpendicular to the axis of the container has been found useful. The second retaining member 26 defines an opening 28. In a preferred embodiment opening 28 is of a smaller cross-sectional area than opening 24 at the second end 20 of first retaining member 16. Preferably opening 28 formed by second retaining member 26 is of a larger cross-sectional area than opening 22 at the first end 18 of the first retaining member 16. The height (H) of the container can be suitable to the lower end (first end) 18 height. The height ($h_1$) from the bottom should be of a sufficient distance to allow a predetermined amount of powder to be placed in the container such that the amount of powder will not extend above the first end 18 of the first retaining member 18. The height to the second end (upper end) 20 of the first retaining member can be of any height sufficient to contain the powder when the container is laid on its side. Thus, in the preferred embodiment, the volume for the powder is the volume of the container below the first end of the passageway 18 which will be called the service volume. In the illustrated embodiment, this service volume is the diameter D times height $h_1$. This service volume is preferably equal to or less than the capture volume defined by the lower portion of the container below the lower side of opening of the first end of the first retaining member bounded by the bottom side 34 of passageway 18 below the opening, the lower portion of the sidewall below the opening and the lower portion of the bottom below the opening. This capture volume is illustrated in FIG. 4 as the volume below line 33 in the embodiment shown FIG. 4. The capture volume is preferable greater than the service volume by about 10% or more. The capture volume may be less than the service volume. The volume of powder used to charge the device can be less than the service volume and thus less capture volume would be needed to retain the powder; however, to prevent a spill from inadvertent overfilling, the capture volume should be equal to or greater than the service volume.

Figure 2:
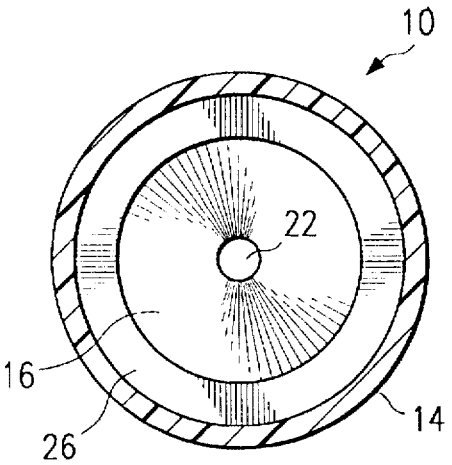
FIG. 2 is a top view of one of the embodiments shown in FIG. 1.

FIG. 2 is a top view of FIG. 1 and like numbers in FIG. 2 refer to like items in FIG. 1. In FIG. 1 a top 30 can be attached to container 10 by frictional fit, threads, or other mechanisms known in the packaging industry.

In use of container 10, a light-weight powder, such as a fingerprint powder 32, is charged in the can to a distance below the first end 18 of first retaining member 16. A brush to apply fingerprint powder is typically one with a handle with a very pliable brush extending conically from the handle. In use, the brush can be inserted into opening 28 and if the brush is rotated, and pushed downwardly the bristles will be compressed by retaining wall 16. The bristles are then pushed through opening 22 and dabbed into the powder 32. As the brush is withdrawn, it will expand within the passageway formed by the first retaining wall 16. With a larger brush it will completely expand and as is withdrawn through opening 28 in the second retaining member 26 the brush will be slightly constricted. This action will scrape excess fingerprint powder from the edges of the brush which will then fall onto the surface of first retaining member 16 and be funneled back into the bottom of the container 10.

Figure 3:
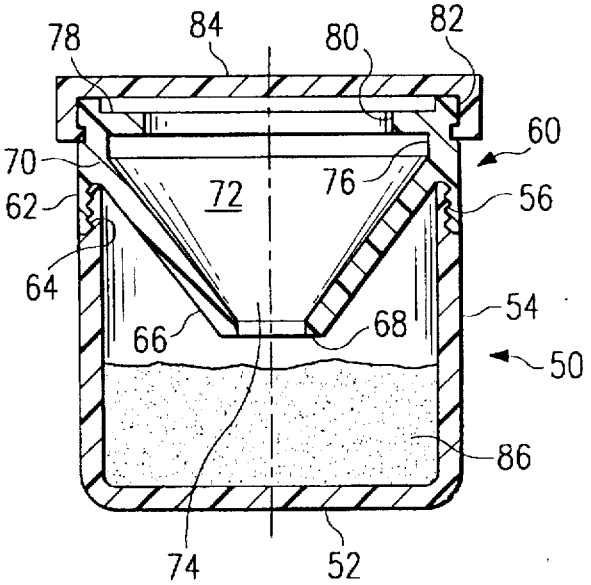
FIG. 3 is a cross-sectional view of an alternate embodiment of the present invention.

FIG. 3 shows an alternate embodiment of the present invention. In FIG. 3 a standard jar 50 is shown having a bottom 52 and extending side walls 54 at the top of side wall 54 is threaded surface 56. Thus, jar 50 can be your typical consumer jar. The jar can be converted to a spill resistant container of the present invention by providing an adapter 60. Adapter 60 has a wall member 62 dimensioned to mate with a selected predetermined container. Wall member 62 preferably has a mating surface 64 for connecting wall 62 to a predetermined container. In the embodiment shown in the mating surface is thread surface 64. Obviously, the mating surface can be a frictional fit surface, a compressible lip, or a surface designed to frictionally engage the interior surface or exterior of the container. Extending inwardly from wall 62 is first retaining member 66 having a lower end 68 and an upper end 70. Retaining wall 66 forms the first passageway 72 having a opening 74 at the first end 68 of wall 66 and an opening 76 at the second end 70 of wall 66. Also extending from wall 62 is ridge member 78. Ridge 78 is positioned above the first retaining member 66 and extends inwardly a predetermined distance to form opening 80. Wall 62 can also be provided with an outwardly extending lip 82 upon which a snap cover 84 can be applied. Obviously, other mechanism can be supplied on wall 62 to permit the attachment of a lid such as a screw thread surface. Once again in use, a finely divided light weight powder 86 is placed in the container such that the top of the powder does not extend above the lower end 68 of retaining wall 66. The dimensions of the attachment 60 are preferably such that the design provides for a capture volume equal or greater than the service volume of the combined predetermined jar 50 and attachment 60.

The present invention may be made from any suitable material such as glass, plastic, metal or a combination thereof Preferably, the materials of construction are static-free such that powder freely falls to the bottom of the container. Additionally, the inner surfaces of the first retaining member and second retaining member should be smooth so that powder is not unduly retained on those surfaces.

FIG. 4 illustrates the operation of a container. When the container is tipped over the majority of the powder 32 is retained by retaining member 16. However, because these powders are so light and finely divided, it is not unusual for some small portion of the powder 32' to travel through opening 22, however it quickly falls and is retained by a second retaining wall 26. When the can is up-righted powder 32' will flow down the retaining wall 16 into the bottom of the container. Tests have shown that a container having fingerprint powder within it can even be thrown with virtually no escape of powder, no matter how the container lands.

Figure 5:
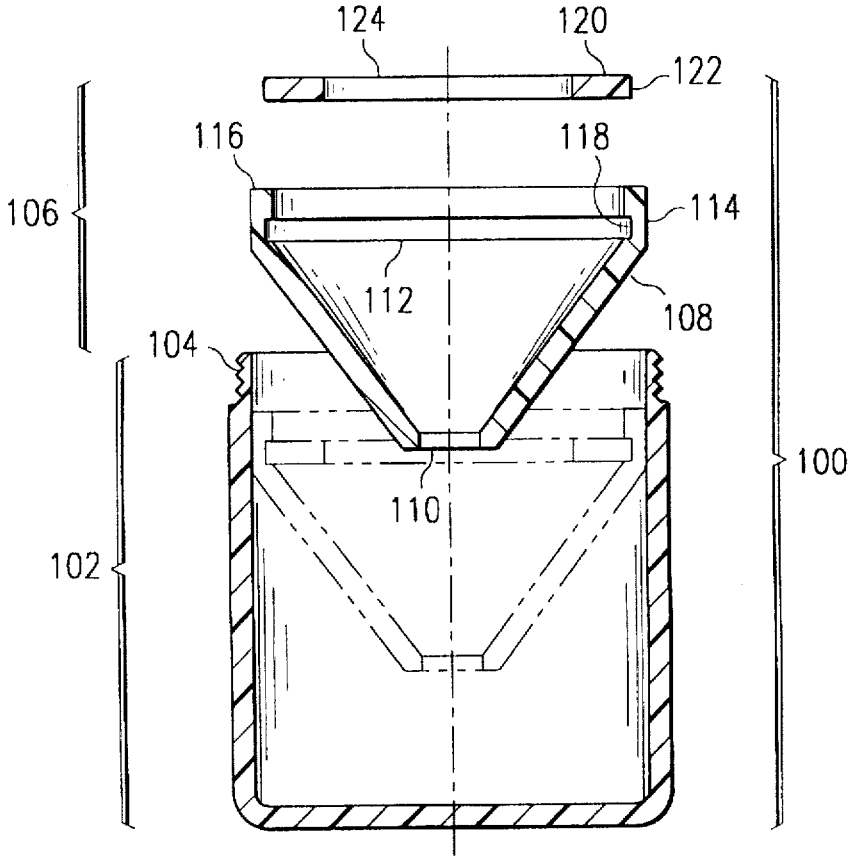
FIG. 5 is an exploded cross-sectional view of another embodiment of the invention.

The container and adapter of the present invention can be constricted in a number of ways such as in one piece or multiple pieces. FIG. 5 is an exploded cross-sectional view. The assembled pieces form a spill resistant container 100. The container 100 is made from ajar 102 having a threaded surface 104 at the outside of the top of jar 102. The adapter 106 is constructed of a first retaining wall 108 in the shape of a funnel. Funnel-shaped wall 108 has an opening 110 at the lower end which is smaller than space opening 112. The retaining wall 108 has a mating surface 114 on its upper end. In the illustrated embodiment it is on the outer side of wall 108 and is dimensioned to fit inside jar 102 such that the wall 108 can be held in jar 102 by functional fit or application of an adhesive. At the upper end 116 of wall 108 the wall forms an inner channel 118 for receiving second retaining wall 120 which is a donut shaped piece with an outer edge sized to mate with channel 118 and an opening 124. In manufacture, wall 108 can be blow or injected molded. Second retaining wall 120 can be molded, stamped or cut. Wall 120 can be snapped into channel 118 and held by frictional fit or adhesives. The adapter 106 thus assembled is attached by suitable method. As illustrated the adapter 106 is positioned within jar 102 and held in place by friction, adhesive or other means.

In construction of the device the first retaining member can be funnel-shaped. The angle of divergence of the funnel preferably results in an inclined surface when the jar is upright having sufficient incline to cause powder to slide or roll down to the lower opening freely or when the jar is lightly tapped.

It has been found that a suitable spill resistant container of the invention can be made with an inner diameter of about 3⅛ inches, H of about 4 inches, $h_1$ of about 2 inches, $h_u$ of about 2 inches, $h_2$ of about 2 inches, where the opening at the lower end of the passageway is about 1 inch in diameter. The upper end of the passageway is about the same diameter as the jar, and the second retaining member has an opening about 1½ inches in diameter.

Modifications and additions to those described above, in relation to preferred embodiments will be apparent to those skilled in the art and such modifications are included within the scope of the below claims.

What is claimed is:

1. A spill resistant container comprising:

a bottom;

a wall extending upwardly from said bottom and forming a container and having a top edge defining an opening;

a first retaining member forming a passageway having a predetermined length with a first end and a second end, said second end of said passageway being attached to said wall at a distance spaced apart from said bottom and said first end being positioned between said second end and said bottom and being spaced apart from said bottom; and a second retaining member forming a continuous ridge which extends inwardly from said wall a predetermined distance and defining an opening at a location above said second end of said first retaining member.

2. The container of claim 1 wherein said first retaining member has an opening at said first end of smaller cross-sectional area than the opening at said second end.

3. The container of claim 2 wherein said second retaining member defines an opening having a cross-sectional area equal to or larger than the opening of said first end of said first retaining member.

4. The container of claim 1 wherein said container has a capture volume equal to or greater than the service volume.

5. The invention of claim 4 wherein said capture volume is greater than said service volume by about 10% or more.

* * * * *